US010453298B2

(12) United States Patent
Hajduk

(10) Patent No.: US 10,453,298 B2
(45) Date of Patent: Oct. 22, 2019

(54) SYSTEM, APPARATUS AND METHOD FOR IMPLEMENTING GAME CHANGES IN A GAMING PLATFORM

(71) Applicant: IGT Global Solutions Corporation, Providence, RI (US)

(72) Inventor: Adam Hajduk, Warsaw (PL)

(73) Assignee: IGT GLOBAL SOLUTIONS CORPORATION, Providence, RI (US)

( * ) Notice: Subject to any disclaimer, the term of this patent is extended or adjusted under 35 U.S.C. 154(b) by 170 days.

(21) Appl. No.: 15/290,993

(22) Filed: Oct. 11, 2016

(65) Prior Publication Data

US 2017/0103607 A1 Apr. 13, 2017

Related U.S. Application Data

(60) Provisional application No. 62/238,770, filed on Oct. 8, 2015.

(51) Int. Cl.
*G07F 17/32* (2006.01)
*G07C 15/00* (2006.01)

(52) U.S. Cl.
CPC ..... *G07F 17/3227* (2013.01); *G07C 15/006* (2013.01); *G07F 17/329* (2013.01); *G07F 17/3209* (2013.01); *G07F 17/3223* (2013.01); *G07F 17/3255* (2013.01); *G07F 17/3258* (2013.01)

(58) Field of Classification Search
None
See application file for complete search history.

(56) References Cited

U.S. PATENT DOCUMENTS

| | | | | |
|---|---|---|---|---|
| 8,495,391 | B2 * | 7/2013 | Gatto | A63F 13/12 345/419 |
| 2003/0069074 | A1 * | 4/2003 | Jackson | G06F 8/20 463/43 |
| 2009/0143128 | A1 | 6/2009 | Cautley | |
| 2016/0110953 | A1 * | 4/2016 | Sotiriou | G07F 17/3225 463/25 |

* cited by examiner

*Primary Examiner* — James S. McClellan
*Assistant Examiner* — Peter J Iannuzzi
(74) *Attorney, Agent, or Firm* — Sage Patent Group

(57) ABSTRACT

A system, apparatus and method are presented wherein games operated by users may be added, modified, and/or deleted in a manner that eliminates the need to substantially reconfigure all or mostly all of the related subsystems. In various embodiments, game containers, game container set-ups, and a game catalog server combine such that desired changes to game types are generated in bundles of game data setup packages and distributed for execution by respective game containers. The game data setup packages contain parameters that can be updated or modified via the game catalog server in order to effectuate desired game additions, modifications or deletions.

18 Claims, 5 Drawing Sheets

SYSTEM, APPARATUS AND METHOD FOR IMPLEMENTING GAME CHANGES IN A GAMING PLATFORM

BACKGROUND

The present disclosure relates generally to gaming and lottery systems, and more particularly to gaming and lottery system platforms wherein existing games may be modified or deleted, and/or new games added, without the need to modify tangential subsystems.

There currently exist a number of system platforms or architectures available for use in providing games or lotteries to consumers. Indeed, the ability to provide such games and lotteries to consumers, particularly at an individual level through direct interactions with gaming or lottery terminals, for example, has sparked a surge in the development of new games and updates to current games. Oftentimes, business requirements dictate that new games be implemented, or changes to existing games be implemented, within a short time period. To compete in this ever-changing environment with time-sensitive demands, it is imperative that new games or updates be implemented and delivered to consumers quickly and with minimal redundant development.

Presently, adding a new game to a lottery user device or terminal may require software programming changes to various subsystems of the lottery platform.

BRIEF SUMMARY

The present disclosure relates generally to a system, apparatus and method wherein particular games presented to users may be added, modified, and/or deleted with minimal programming impact to tangential subsystems. More particularly, the present disclosure provides for a system wherein game containers, game container setups, and a game catalog server combine to facilitate relatively seamless addition, modification, and/or deletion of games from a lottery or gaming platform, environment or system. In various embodiments, the game containers can include programming executable for specific game types (e.g., lottery drawing games, lottery instant games), regardless of the specific games that are members of the game types. Further, in various embodiments, the game catalog server stores game container setups, where the game container setups contain setup parameters for each game type, and are adapted based upon the lottery subsystem involved.

In various embodiments, a game catalog server is provided that can include game setup bundles configured to transmit necessary parameters for a particular set of games (e.g., lottery games, bingo games, etc.) to different subsystems. When a game is desired to be added, updated or deleted, the game catalog server can be accessed, and a setup bundle can be generated with individual game container setups associated with specific lottery platform subsystems. The setup bundle can be dispensed to the appropriate subsystems to implement the desired change, whereby each recipient subsystem employs its relevant part of the setup bundle and ignores the rest.

DETAILED DESCRIPTION

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

Example embodiments such as disclosed herein can be used to support regulated state or governmental lotteries, private gaming corporations, both physical and Internet casinos, or other entities that provide legal gaming to customers. While the examples are described principally with reference to regulated state lotteries, it will be appreciated that the same solutions may be applied in other wagering or regulated gaming applications. The example embodiments described below include references to a host or a host system. A host or host system may be implemented as a single computing system or as a collection of computing systems or subsystems which are communicatively coupled, and each component or subsystem of the exemplary host can be implemented in hardware, software or a combination thereof.

Figure 1:
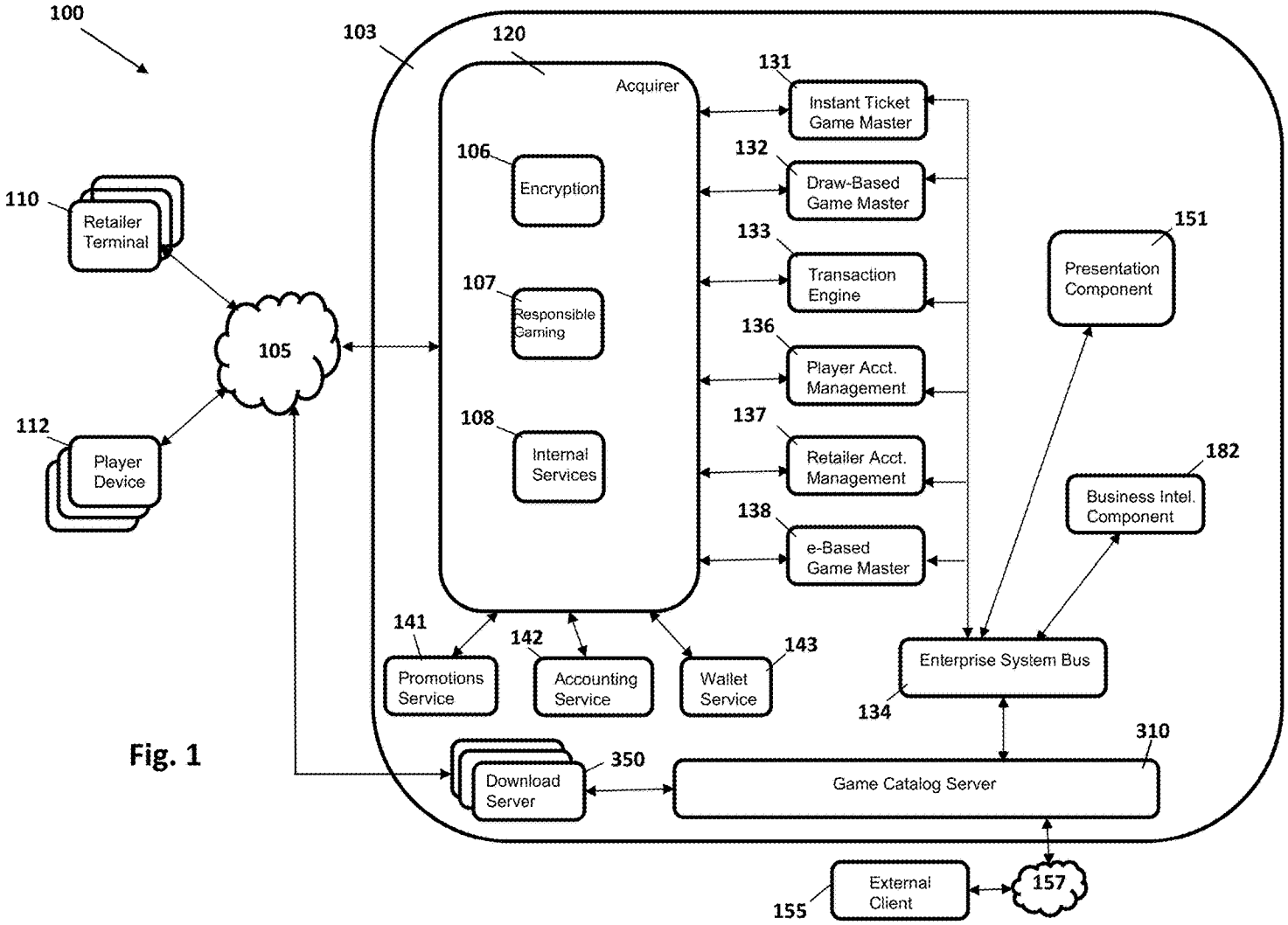
FIG. 1 illustrates an exemplary gaming or lottery system in accordance with the present disclosure.

Referring now to FIG. 1, an exemplary lottery system 100 in accordance with the present disclosure is illustrated, including a lottery host 103 and various subsystems. The host 103 can contain a single central server, a plurality of distributed servers, or any other embodiment capable of facilitating the host and subsystem operations. The server may include and/or be in communication with one or more databases to facilitate operations as described herein, as well as necessary and desired storage of system events, relevant programming and data.

As shown in FIG. 1, retailer point-of-sale (POS) terminals 110 and player terminals (e.g., laptops, tablets, PCs, interactive televisions, smartphones and other personal communication devices) 112 comprise two of the subsystems and communicate over a network 105 with the lottery system host 103. The network 105 can be a private network or a public network, such as the Internet, for example. For purposes of the present disclosure, either or both of the retailer terminal subsystem 110 and the player terminal subsystem 112 can be referred to as a remote lottery terminal subsystem. The terminals 110, 112 include appropriate user input elements (e.g., keyboard, mouse, touchscreen interface) and output elements (e.g., display screen, speaker) for receiving and displaying game and wager information, for example.

The host 103 includes an acquirer 120 that acts to receive and send communications from and to the terminals 110, 112, and can include various service components such as an encryption component 106, responsible gaming component 107 and other internal service components represented generally at 108, which can include, without limitation, a subscription service to manage player subscriptions, a favorite bets service to manage players' preferred wagers, a validation service to verify winning wagers, a randomization service to provide a uniform method of generating random numbers requested by a game and a reporting service to report the results of a gaming transaction to the user or the operator, for example. Messages received from terminals 110, 112 can be routed by the acquirer 120 to various other subsystems, such as instant ticket game master subsystem 131, draw-based ticket game master subsystem 132, transaction engine subsystem 133, backend enterprise system bus subsystem 134, player account management subsystem 136, retailer account management subsystem 137, electronic based ticket game master subsystem 138, promotions service subsystem 141, accounting service subsystem 142, and wallet service subsystem 143, for example, depending upon the message involved.

The dedicated subsystems handle dedicated services in the overall platform. For instance, instant ticket game master subsystem 131 manages communications and functionality related to instant ticket games. Draw-based ticket game master subsystem 132 manages communications and functionality related to draw-based ticket games. Transaction engine subsystem 133 manages communication and functionality s related to wager transactions. Player account management subsystem 136 manages communications and functionality related to player account details, such as player identifications, loyalty points, favorite wagers and similar player details. Retailer account management subsystem 137 manages communications and functionality related to retailers, including identification information, available games, terminal types and other related information. Electronic based ticket game master subsystem 138 manages communications and functionality related to e-ticket games. Business Intelligence (BI) subsystem 182 is a subsystem that processes data for particular game types, including for example, rules to normalize data into common representation used in business intelligence and data aggregation rules, for example. Retailer terminal subsystem 110 is operable to manage retailer terminal interactions, including for example, manual entry screens, and specific layouts for game types supported in particular containers (e.g. container 200), for example. Player terminal subsystem 112 is operable to manage player terminal interactions, including, for example, manual entry screens, and specific layouts for game types supported in particular container (e.g. container 200). The lottery acquirer subsystem 120 is operable to manage transaction routing for particular game types. These various subsystems may also interact with other subsystems, such as for example, a presentation subsystem 151 that manages user interfaces such as game presentations for users, retailer displays, and administrative displays, for example. Enterprise System Bus subsystem 134 is a subsystem handling transaction routing, and can further handle data for particular game types. An external client 155, such as a user computing device, can access the system bus 134 via network 157 in order to access administrative displays and other user interfaces associated with the host 103. Network 157 can be a private network or a public network, such as the Internet, for example. The external client 155 includes appropriate user input elements (e.g., keyboard, mouse, touchscreen interface) and output elements (e.g., display screen, speaker) for receiving input and displaying suitable user interfaces as described elsewhere herein.

As a specific example, if a wager request is received by acquirer 120 from a retailer terminal 110, the source terminal 110 must be verified as being signed on via retailer account management subsystem 137, the wager request must be forwarded to the proper game master or engine (e.g., instant game master subsystem 131 or draw-based game master subsystem 132), and then separate communications can be routed from the acquirer 120 to ancillary back-end services such as promotions service 141 for related customer promotions, accounting service 142 for related accounting processes and wallet service 143 for related debit or credit functions associated with the retailer and/or player involved in the wager, as appropriate.

As disclosed herein, game modules may be desirably updated, modified, and/or changed with minimal impact on the remainder of the system using a plurality of software containers. Each software container contains programming that is operable to perform at least one function common to a plurality of games of a specific game type, wherein the programming is executable by its respective lottery subsystem. For example, drawing-based or "Lotto" games are a defined game type, and may include specific games such as MegaMillions™, Lotto 6/49™, Cash5™ and PowerBall™, for example. These are similar games in the sense that each is a draw-based lottery game. Nevertheless, these games are also distinguishable based on elements such as specific rules, prize pools, available jurisdictions and other distinctions. The software container for these games can be a "Lotto" software container and can provide functionality that is a superset of all individual functionality of the individual member games, or game subtypes, of the container. Such functionality is possible given the significant overlap in communication protocols and operation associated with similar types of drawing-based games. For example, this functionality can include receiving and storing selected numbers, randomly generating winning numbers and communicating winning numbers.

In various embodiments, each software container is associated with and operable by a specific subsystem, such that the instant ticket game master subsystem 131 will have its own software containers that are separate and distinct from the software containers of the draw-based game master subsystem 132. Further, subsystems can operate a plurality of software containers, each relating to a specific game type. For example, the transaction engine subsystem can employ a Lotto type game software container, a Keno type game software container, a Bingo type game software container, and other game-type software containers.

The differences in the respective games can be implemented by the software containers through the use of setup parameters, i.e., data. For example, Cash5™ involves the selection of five numbers from one to forty-one, whereas MegaMillions™ involves the selection of six numbers—five numbers from one to seventy-five and one number from one to fifteen. If the game setup for Cash5™ were to change such that the player is to select five numbers from one to forty-two, such a change can be implemented via the present system using a bundle of game parameters as discussed hereinafter.

Figure 2:
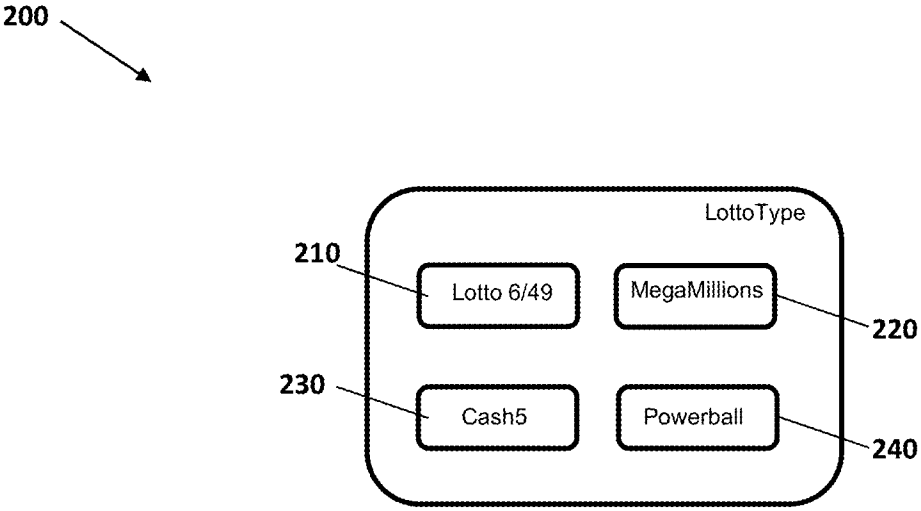
FIG. 2 illustrates an exemplary game container according to one embodiment of the present disclosure.

An exemplary game container 200 is shown in FIG. 2 as a container for draw-based or Lotto-type games. Other game containers may include specific containers for Add-on type games, Keno type games, Bingo type games, Numbers type games, Sports type games, Odds type games, and/or Raffle type games, for example. In the exemplary embodiment shown in FIG. 2, the game container 200 contains Lotto-type games, including Lotto 6/49™ game 210, MegaMillions™ game 220, Cash 5™ game 230 and Powerball™ game 240. Specifically, the game container 200 contains programming for implementing Lotto-type game functionality, customized to meet the needs of each subsystem. For example, the Lotto-type game container 200 can implement on the draw-based game master subsystem 132 everything related to wager processing and logging, while on the retailer terminal subsystem 110 or player terminal subsystem 112, a different Lotto-type container can implement data presentation and data input functions. On the Business Intelligence subsystem 182, another Lotto-type container can implement relevant data processing and aggregation. A Lotto-type game container configured to be implemented on the presentation subsystem 151 may be operable to manage draw-based game end user interfaces, presentation, and printing of tickets, for example. A Lotto-type game container 200 configured to be implemented on the transaction engine subsystem 133 may be operable to handle transaction-related details associated with Lotto-type tickets, for example. Each game container (e.g., 200) can thus support the same number of Lotto-type games on each subsystem, with the differences between the specific member games, or game subtypes, being controlled by the setup parameters. It will be appreciated that not every game container will be relevant to every subsystem. For instance, a Lotto-type game container will not be relevant to the instant ticket game master subsystem 131. Nevertheless, a Numbers type game container and a Bingo type game container may be independently operable by the instant ticket game master subsystem 131 in connection with different numbers-based and Bingo-based instant games, respectively.

Each game container can be initially created by programming desired functions for each subsystem for each game type into a game application. Relevant runtime dependencies, tools, libraries, configuration files and anything needed to run with the game application are also incorporated, such that each game container can operate as desired for its specific subsystem. The containers can be stored and installed on an appropriate server for use with the system of the present disclosure and execution by a respective subsystem. The containers for the terminal subsystems 110, 112 can be stored and installed on an appropriate server associated with host 103, or remotely on respective terminals and operable thereby. In various embodiments, each container is created so as to operate independently and in isolated fashion from the underlying operating system, infrastructure and other subsystems, thereby allowing faster and easier deployment in various different lottery platforms. In various embodiments, external services can be employed to build the game containers, including services such as Docker™, which is commercially available from Docker Inc. of San Francisco, Calif. The containers can be built to run on open standards, in accordance with various embodiments disclosed herein. Any changes needed to the underlying game functionality of a game container can be made by adapting the game container programming as needed. When game containers are deployed, each subsystem operates its respective game container as required for the particular subsystem involved, such that operation of an actual game can occur as long as the relevant game setup parameter data is received.

Game container setup parameters provide data for each game within a given game type. For instance, for the Lotto-type game container 200 illustrated in FIG. 2, with respect to the draw-based game master subsystem 132, the game setup parameters can include the initial draw setup, wager parameter setup, the game name, the game unique identifier and other data. For the Lotto-type game container as implemented on a remote terminal 110, 112, the game setup parameters include logo graphics for a game, betslip description, screen layout and similar aspects. Thus, the game container setup contains smaller data packages dedicated for specific subsystems, each of which will only use the part of the game container setup which is dedicated for it. In various embodiments, game container setups can be implemented as a .zip file, containing one or more Java Archive (.jar), Web module (.war) and/or Enterprise Application Archive (.ear) files dedicated for each subsystem, and can further include a file with digital signatures for overall integrity. The use of such game containers and game container setups allows for modification, deletion or addition of games to the system without having to actually modify programming of other subsystems. For instance, each game container reads its dedicated new file of game container setups when executed in order to implement the change represented by the new file. By not requiring programming modification of other subsystems, full re-testing of each software program or application to ensure integrity and consistency is avoided.

Referring back to FIG. 1, the system 100 further includes a game catalog server 310 in communication with the host 103 and related subsystems. The game catalog server 310 can be a single server or a plurality of distributed servers, for example, and may include and/or be in communication with one or more databases to facilitate operations as described herein. In various embodiments, the game catalog server 310 maintains and generates setup bundles for the various game containers (e.g., game container 200) needed by the system 100. The game catalog server 310 is operable to create or add a new game setup, read, retrieve, search, or view an existing setup, update or edit an existing setup, and/or delete/deactivate existing games. In various embodiments, these operations are made available by dedicated user interfaces implemented via the presentation component 151. For example, a user can access the game catalog server 310 via an external client (e.g., client 155 over network 157), and appropriate administrative screens or user interfaces are provided by the presentation component 151 to enable a user to perform the desired operation. For example, a user can search for, retrieve and view game parameter setup details, and can further delete, edit and/or add a new game setup using traditional input mechanisms such as a mouse and keyboard, for example. The user can retrieve all setup parameter data from desired subsystems. Any requested changes can then be entered via client 155, for example, stored by the game catalog server, and propagated to the relevant subsystems via push messages from the game catalog server 310 and/or via a download server 350, described hereinafter.

For example, a Lotto game setup package may contain draw parameters, wager parameters, bet parameters, cancel parameters, reprint parameters and validation parameters. In various embodiments, hundreds of parameters may be involved with a given game setup package. For instance, the draw parameters can include parameters such as the base number of numbers involved in a wager (e.g., 5, 6, etc.), the number of total wins, the number of regular wins, the big winner amount, the number of prize divisions and scores of other parameters that may be shared among all Lotto games. The specific data associated with each game subtype may be different (e.g., Cash5™ involves the selection of five numbers from one to forty-one, whereas MegaMillions™ involves the selection of six numbers) and these differences can be specified within the parameters in the game setup package. The wager parameters can include elements such as the lowest number allowed to wager (e.g., 1), the highest number allowed to wager (e.g., 45), whether the manual entry of bet data is allowed, whether quick pick is allowed, and similar parameters. Similar to the draw parameters, the specific data associated with each game subtype may be different, and these differences can be specified within the game setup package. To implement a change, a user may access the game catalog server 310 via client device 155, retrieve setup parameter data associated with a game type (e.g., Lotto), and delete, edit and/or add a new game setup. For example, the user may implement a parameter change such that a Lotto game involving the selection of numbers from 1 to 45 is changed to involve the selection of numbers from 1 to 46. Individual parameters can be added, deleted or modified to generate the desired adaptation, and the resulting game setup data packages representing the desired adaptation are bundled and issued by the game catalog server to the respective subsystems. For example, to add a new game, additional parameters associated with the new game can be added to the game setup data package. To delete an existing game, existing parameters associated with the existing game can be deleted. It will be appreciated that a game bundle may include a game setup data package having parameter changes associated with one subsystem while not having parameter changes for other subsystems. Each subsystem receives the bundle and uses only that portion of the bundle that is directed to its operation. With these technical improvements, rather than having to reconfigure multiple subsystems for a new game, for example, only new parameters need be implemented and transmitted to the subsystems. Accordingly, administrators of a gaming or lottery system may improve upon the games provided to users without having to undertake the substantial burden typically associated with substantially reconfiguring, re-programming or re-starting various subsystems to accommodate new functionality or communication protocols, for example. Thus, more changes can be made to the lottery or gaming system at a faster pace.

In various embodiments, one or more download servers 350 may handle data downloads for terminals (e.g., terminal 110). Such data downloads may include terminal firmware, terminal applications, and/or new game containers (e.g., game container 200) and their accompanying game container setup packages dedicated for the particular game container operated by the terminal subsystem 110. In various embodiments, the download server 350 can identify and authenticate terminal devices as appropriate.

Figure 3:
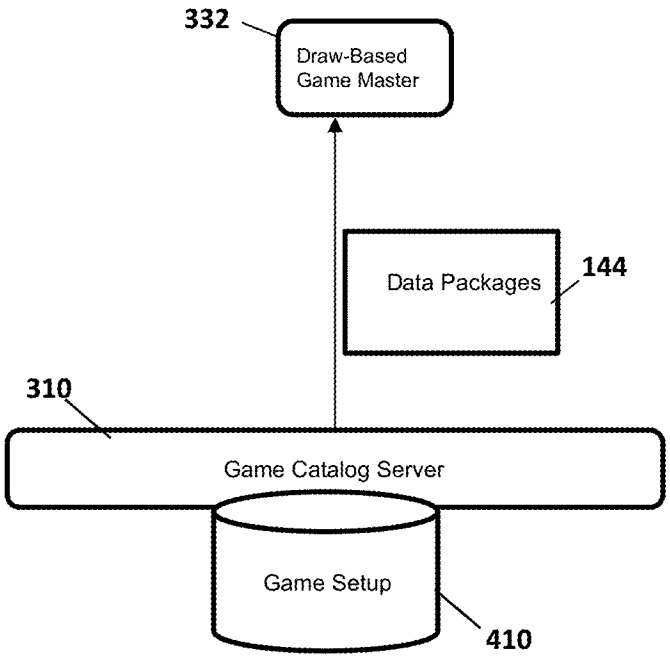
FIG. 3 illustrates an exemplary game catalog server and game setup according to embodiments of the present disclosure.

Data packages that may be required for a particular game container (e.g., container 200) may be loaded from game catalog server 310. FIG. 3 illustrates how the game catalog server 310 is employed, according to one embodiment of the present disclosure. As shown therein, the game catalog server 310 may include, for example, one or more game setups 410 stored in a database. The game setup 410 may include initial or modified game container parameters for each subsystem, as configured using an external client (e.g., 155 in FIG. 1), for example. In a specific example, the game setup 410 may include the initial or modified game container parameters for the draw-based ticket game master 332 subsystem, including the the game name, the game unique identifier, and the draw setup, for example. As shown in FIG. 3, the game setup 410 can be transmitted as a data package 144 from the game catalog server to the draw-based game master subsystem 332. It will be appreciated that other game setups 410 may be included that similarly include the initial or modified game container parameters for the various other subsystems in game server system 300. Importantly, the game setups, individually or as bundled, include no executable files, but rather data files to be employed by the executable programming of the respective game containers.

Figure 4:
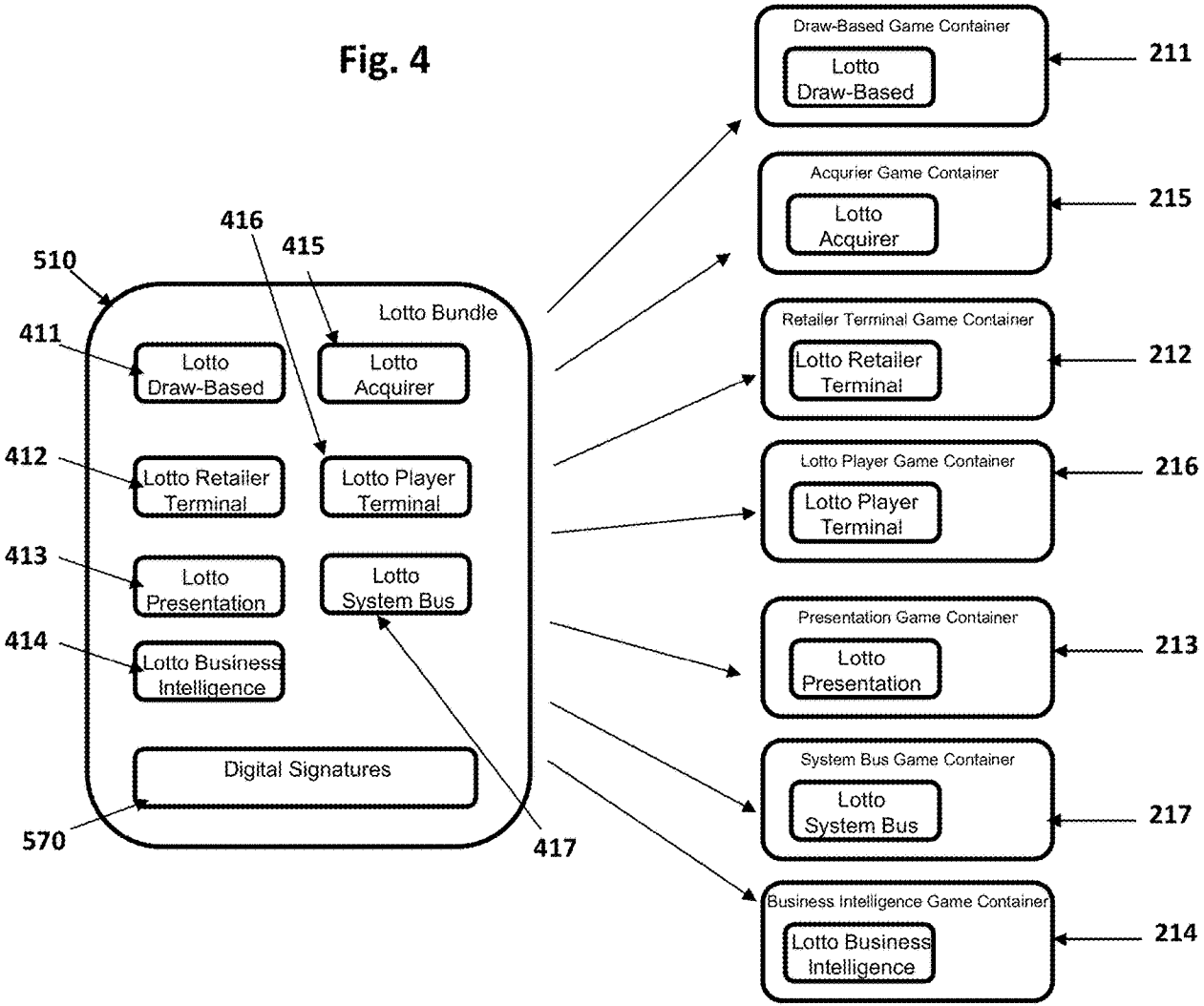
FIG. 4 illustrates an exemplary bundle of game setups and corresponding game containers for various subsystems according to one embodiment of the present disclosure.

By way of further example, referring now to FIG. 4, an exemplary bundle 510 of game setups 410 is presented for an exemplary "Lotto" game. The bundle 510 may include multiple game setups, including Lotto draw-based ticket game master game setup 411; remote retailer terminal game setup 412; presentation component game setup 413; business intelligence (BI) component game setup 414; acquirer game setup 415; remote player terminal game setup 416; and enterprise system bus game setup 417. The game setups 411-417 can then be sent to the various subsystems as a bundle by the game catalog server (310 in FIG. 1), for example, and each subsystem uses only that portion of the bundle that is directed to its operation. In other words, the draw-based ticket game container 211 employs setup 411, the retailer terminal game container 212 employs setup 412, the presentation component game container 213 employs setup 413, the BI game container 214 employs setup 414, the acquirer game container 215 employs setup 415, the player terminal game container 216 employs setup 416, and system bus game container 217 employs setup 417. The bundle thus may provide more data than each game container needs, but the game containers retrieve the portion of the bundle required to implement the desired game change By representing an aggregated group of game setups for different subsystems, the individual bundle helps capsulize desired changes and maintain the overall integrity of the system. Individual bundles effectively organize multiple game setups for specific game types, wherein the game setups correspond to individual subsystems. Once the bundle is delivered and the game setups are processed by respective game containers, the desired changes to the game type are implemented. Desired changes for the game type can include changes to specific game subtypes, for example. Digital signatures 570 may, in some embodiments, be utilized to verify proper data transfer.

With some subsystems, changes may not be necessary such that no specific game setup parameters need to be communicated. For example, retailer account manager subsystem 137 may include retail services for the system and may be game agnostic, such that it requires no specific game container and no game setup parameters. However, retailer account manager subsystem 137 may still receive information of active games from the game catalog server 310. Information about games available on particular terminals, retailer limits, retailer privileges, etc. may be loaded to the host 300 for access during transaction run time.

In various embodiments, game parameter setup data and/or bundles can be targeted to specific game subtypes, i.e., specific games within a game type. For example, within the Lotto-type game set, the MegaMillions™ game is a specific game. A suitable bundle can be developed that addresses just the game subtype for each appropriate subsystem, according to various embodiments.

It will be appreciated that aspects of the system described herein can facilitate the generation and operation of both static and dynamic data packages, and can further facilitate the generation and operation of separate game containers for the "front end" user experience as well as for the "back end" processing outside of the user's view. For example, static data packages can include elements such as graphics, betslip layouts, screen layouts, printout layouts, ticket logos, game screen logos and similar features for the front end of the retailer 110 and/or player 112 terminal subsystems. Dynamic parameters can include details which can be frequently changed, such as a list of soccer matches which changes from week to week, for example. The retailer terminal 110, player terminal 112 and presentation 131 subsystems can employ separate front-end and back-end containers, according to various embodiments of the present disclosure. The game catalog server 310 can issue the bundle of static parameters directly or via the download server 350, as described above. Dynamic parameter updates may not be generated by the game catalog server 310, but may be generated and delivered to the terminal directly by the appropriate subsystem (e.g., draw-based game master subsystem 132), in accordance with various embodiments. Back-end containers can process game configuration details for back end operations such as, for example, how many number selections must be picked for a valid wager.

Figure 5B:
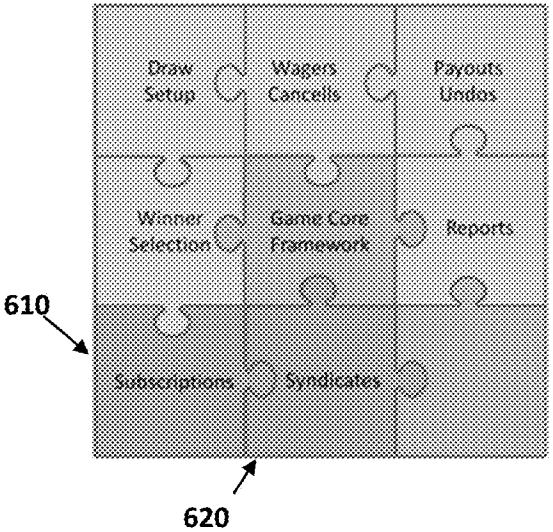
FIGS. 5A and 5B illustrate exemplary plugins according to one embodiment of the present disclosure.
Figure 5A:
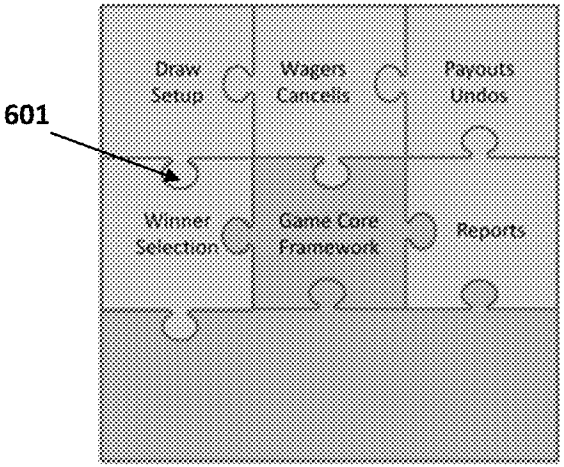

Referring now to FIGS. 5A and 5B, an exemplary set of plugins are presented that may be used, for example, within the draw-based ticket game master subsystem 132. Game containers (e.g., game container 211) implemented on the draw-based ticket subsystem may focus on business logic of particular games. In some embodiments, plugins may be allowed which may enhance or modify the flow for business logic for particular transactions. Plugins may also implement dedicated transaction types, not supported by the original core game. For example, plugin add-ons "subscriptions" 610 and/or "syndicates" 620 may be employed. In general, plugins may provide extension points (e.g. extension point 601) that provide "hooks" to other segments. Plugins may advantageously offer new functionality that may not have been present in the original game (e.g., a general lottery game). In various embodiments, plugins can be provided as separate .jar files, for example, and can be injected into a running service without restart by the host, for example.

Aspects of the present disclosure also pertain to providing a flexible communication protocol which allows for dynamic changes and does not break backward compatibility. The system can be implemented, in some embodiments, with a lottery system API (REST/JSON), Thrift or XML communication protocols. In some embodiments, system 300 may be implemented using a lottery system API for communication between internal subsystems. Data persisted internally may be stored as JSON, Thrift, or XML, for example. An advantage is that by removing proprietary (position-based) binary formats and using flexible open standard (key-value) formats for data storage and communication allow for the possibility to implement changes in the protocol without breaking backward compatibility. In various embodiments, an API can be defined to handle parameter updates across the system. Additionally, game subtypes disclosed herein may require the addition of subtype data to all communication messages.

It will be appreciated that all of the disclosed methods and procedures herein can be implemented using one or more computer programs or components. These components may be provided as a series of computer instructions on any conventional computer-readable medium, including RAM, SATA DOM, or other storage media. The instructions may be configured to be executed by one or more processors which, when executing the series of computer instructions, performs or facilitates the performance of all or part of the disclosed methods and procedures.

Unless otherwise stated, devices or components of the present disclosure that are in communication with each other do not need to be in continuous communication with each other. Further, devices or components in communication with other devices or components can communicate directly or indirectly through one or more intermediate devices, components or other intermediaries. Further, descriptions of embodiments of the present disclosure herein wherein several devices and/or components are described as being in communication with one another does not imply that all such components are required, or that each of the disclosed components must communicate with every other component. In addition, while algorithms, process steps and/or method steps may be described in a sequential order, such approaches can be configured to work in different orders. In other words, any ordering of steps described herein does not, standing alone, dictate that the steps be performed in that order. The steps associated with methods and/or processes as described herein can be performed in any order practical. Additionally, some steps can be performed simultaneously or substantially simultaneously despite being described or implied as occurring non-simultaneously.

It will be appreciated that algorithms, method steps and process steps described herein can be implemented by appropriately programmed computers and computing devices, for example. In this regard, a processor (e.g., a microprocessor or controller device) receives instructions from a memory or like storage device that contains and/or stores the instructions, and the processor executes those instructions, thereby performing a process defined by those instructions. Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on a user's computer, partly on a user's computer, as a stand-alone software package, partly on a user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Where databases are described in the present disclosure, it will be appreciated that alternative database structures to those described, as well as other memory structures besides databases may be readily employed. The drawing figure representations and accompanying descriptions of any exemplary databases presented herein are illustrative and not restrictive arrangements for stored representations of data. Further, any exemplary entries of tables and parameter data represent example information only, and, despite any depiction of the databases as tables, other formats (including relational databases, object-based models and/or distributed databases) can be used to store, process and otherwise manipulate the data types described herein. Electronic storage can be local or remote storage, as will be understood to those skilled in the art. Appropriate encryption and other security methodologies can also be employed by the system of the present disclosure, as will be understood to one of ordinary skill in the art.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

What is claimed is:

1. A system, comprising:

a host storing a plurality of software containers for at least one lottery game type, wherein each of the plurality of software containers performs at least one function common to a plurality of game subtypes of the at least one lottery game type;

a plurality of lottery subsystems in communication with the host, wherein each of the plurality of lottery subsystems executes a respective one of the plurality of software containers; and a game catalog server in communication with the plurality of lottery subsystems, the game catalog server comprising at least one processor and at least one memory device which stores a plurality of instructions, which when executed by the at least one processor, cause the at least one processor to:

generate at least one bundle for the at least one lottery game type, the at least one bundle comprising a plurality of game setup data packages, wherein each of the plurality of game setup data packages comprises non-executable data files including at least one parameter employable by a respective one of the plurality of software containers, and wherein each of the plurality of game setup data packages is dedicated to only one of the plurality of lottery subsystems; and transmit the at least one bundle to the plurality of lottery subsystems, wherein each of the plurality of software containers is associated with only one of the plurality of lottery subsystems and is limited to reading the game setup data package dedicated to the lottery subsystem associated with the software container.

2. The system of claim 1, wherein each of the plurality of lottery subsystems further executes a respective one of the plurality of software containers with a respective one of the plurality of game setup data packages.

3. The system of claim 1, wherein the plurality of lottery subsystems comprises at least a lottery drawing-based game subsystem and a presentation subsystem, wherein the plurality of software containers comprises at least a lottery drawing-based game container and a presentation container, and wherein the at least one bundle comprises: (a) a first game setup data package comprising a plurality of lottery drawing-based game parameters employable by the software container for the lottery drawing-based game subsystem, and (b) a second game setup data package comprising a plurality of presentation parameters employable by the software container for the presentation subsystem.

4. The system of claim 1, wherein the plurality of lottery subsystems comprises a remote lottery terminal subsystem, wherein the plurality of software containers comprises at least one remote lottery terminal software container, and wherein at least one of the game setup data packages comprises a plurality of remote lottery terminal game parameters employable by the at least one remote lottery terminal software container.

5. The system of claim 4, wherein the remote lottery terminal subsystem comprises a display, and wherein the at least one remote lottery terminal software container comprises a front-end container and a back-end container, wherein the front-end container generates at least one presentation for the display and the back-end container performs at least one game configuration.

6. A method, comprising:

providing a host comprising a plurality of lottery subsystems, with each of the plurality of lottery subsystems comprising a respective software container that performs at least one function common to a plurality of game subtypes of a specific lottery game type;

storing a plurality of game setup data packages associated with the specific lottery game type;

causing at least one processor to adapt at least one of the plurality of game setup data packages;

causing the at least one processor to generate a bundle comprising non-executable data files including at least the at least one adapted game setup data package, wherein the at least one adapted game setup data package is dedicated to only one of the plurality of lottery subsystems; and causing the at least one processor to transmit the bundle to the plurality of lottery subsystems, whereby execution of the respective software container by its respective lottery subsystem with the at least one adapted game setup data package implements a desired change for the specific lottery game type, wherein each software container is associated with only one of the plurality of lottery subsystems and is limited to reading the adapted game setup data package dedicated to the lottery subsystem associated with the software container.

7. The method of claim 6, wherein each of the plurality of game setup data packages comprises at least one game parameter, and wherein causing the at least one processor to adapt at least one of the plurality of game setup data packages comprises adding a new game parameter.

8. The method of claim 6, wherein each of the plurality of game setup data packages comprises at least one game parameter, and wherein causing the at least one processor to adapt at least one of the plurality of game setup data packages comprises modifying the at least one game parameter.

9. The method of claim 6, wherein each of the plurality of game setup data packages comprises at least one game parameter, and wherein causing the at least one processor to adapt at least one of the plurality of game setup data packages comprises deleting the at least one game parameter.

10. The method of claim 6, wherein causing the at least one processor to adapt at least of the plurality of game setup data packages is in response to receiving a request from an external device in communication with the host.

11. The method of claim 6, wherein causing the at least one processor to adapt at least one of the plurality of game setup data packages comprises adding a new game subtype.

12. The method of claim 6, wherein causing the at least one processor to adapt at least one of the plurality of game setup data packages comprises deleting a game subtype from the plurality of game subtypes.

13. A game catalog server, comprising:

at least one processor; and at least one memory device which stores a plurality of instructions, which when executed by the at least one processor, cause the at least one processor to:

generate at least one bundle of game setup data packages for a specific lottery game type, the at least one bundle comprising non-executable data files including a plurality of game setup data packages, wherein each of the game setup data packages is dedicated to only one of a plurality of lottery subsystems; and transmit the at least one bundle to the plurality of lottery subsystems, wherein each of the plurality of lottery subsystems comprises a respective software container programmed to perform at least one function common to a plurality of game subtypes of the specific game type, and whereby execution of a respective software container by at least one of the plurality of lottery subsystems with at least one of the plurality of game setup data packages implements a desired change for the specific game type, wherein each software container is associated with only one of the plurality of lottery subsystems and is limited to reading the game setup data package dedicated to the lottery subsystem associated with the software container.

14. The game catalog server of claim 13, wherein the change comprises a modification to at least one of the plurality of game subtypes.

15. The game catalog server of claim 13, wherein the plurality of instructions further cause the at least one processor to adapt at least one of the plurality of game setup data packages.

16. The game catalog server of claim 15, wherein each of the plurality of game setup data packages comprises at least one game parameter, and adapting at least one of the plurality of game setup data packages comprises adding a new game parameter.

17. The game catalog server of claim 15, wherein each of the plurality of game setup data packages comprises at least one game parameter, and wherein adapting at least one of the plurality of game setup data packages comprises modifying the at least one game parameter.

18. The game catalog server of claim 15, wherein each of the plurality of game setup data packages comprises at least one game parameter, and wherein adapting at least one of the plurality of game setup data packages comprises deleting the at least one game parameter.

* * * * *